US005588378A

United States Patent [19]

Mancini

[11] Patent Number: 5,588,378

[45] Date of Patent: Dec. 31, 1996

[54] COMBUSTION ENHANCEMENT SYSTEM WITH IN-BED FOILS

[75] Inventor: Rick A. Mancini, Endicott, N.Y.

[73] Assignee: New York State Electric & Gas Corporation, Binghampton, N.Y.

[21] Appl. No.: 423,088

[22] Filed: Apr. 18, 1995

[51] Int. Cl.[6] ..... F23K 3/00

[52] U.S. Cl. ..... 110/101 A; 110/248

[58] Field of Search ..... 110/243, 245, 110/248, 257, 270, 300, 101 A

[56] References Cited

U.S. PATENT DOCUMENTS

| | | | |
|---|---|---|---|
| 421,288 | 2/1890 | Kennedy | 110/300 |
| 518,714 | 4/1894 | Craney | 110/298 |
| 697,620 | 4/1902 | Green et al. | 110/270 |
| 3,152,562 | 10/1964 | Cohan et al. | 110/257 |
| 4,510,873 | 4/1985 | Shigaki | 110/289 |
| 4,876,972 | 10/1989 | Mrklas | 110/298 |

FOREIGN PATENT DOCUMENTS

| | | | |
|---|---|---|---|
| 507421 | 9/1920 | France | 110/270 |

*Primary Examiner*—Noah P. Kamen

*Attorney, Agent, or Firm*—Roylance, Abrams, Berdo & Goodman, L.L.P.

[57] ABSTRACT

A combustion enhancement system with in-bed foils are utilized to enhance combustion and emissions. The combustion enhancement system is especially designed for use in a traveling grate-type stoker in which the combustion foils are positioned on the top surface of the grate such that the fuel is moved past the foils by the grate. The combustion foils are provided with a high pressure fluid, such as a gas, to be injected into the fuel. The combustion foils are shaped to divide the fuel such as to create turbulence within the fuel. Preferably, the fluid is injected into the fuel at the point of turbulence.

38 Claims, 3 Drawing Sheets

COMBUSTION ENHANCEMENT SYSTEM WITH IN-BED FOILS

FIELD OF THE INVENTION

The present invention relates to using one or more combustion foils for enhancing combustion of a furnace. More specifically, the combustion foils of the present invention are particularly suited for use in the fuel bed of a stoker to enhance combustion of the fuel. The combustion foils inject non-aqueous, combustion enhancing fluids, such as air, oxygen, etc., into the fuel as well as creates turbulence in the fuel to enhance combustion of the fuel.

BACKGROUND OF THE INVENTION

In the United States, most industrial furnaces or boilers either use a stoker or a pulverized coal burner for burning the fuel. Stokers are less efficient than pulverized coal burners and are more limited in controlling the combustion process and the formation of gas pollutants. While pulverized coal burners are more efficient than stokers, they also have certain disadvantages. For example, pulverized coal burners require expensive pulverizing and handling equipment with high operating costs for mechanical power. Thus, pulverized coal units are only typically economically feasible for large installations. Stokers, on the other hand, are often preferred over pulverizers because of their greater operating range, their capability of burning a wide range of solid fuel and their lower power requirements.

The functions of a stoker are (1) to feed fuel to a furnace combustion zone at a steady but easily controllable rate, (2) to admit an evenly distributed supply of air to the fuel, (3) to retain the burning fuel in the combustion zone until complete combustion of all of the fuel, and (4) to separate the ash without permitting much air leakage. The efficiency of a stoker is largely measured by the completeness with which it combusts the fuel and how well this can be accomplished while maintaining a low percentage of excess air. Obviously, the efficiency of a stoker-type furnace depends largely on the type of fuel being burned.

There are several different types of stokers, such as an overfeed type, a single retort type and a traveling grate type. Examples of some prior art furnaces with traveling grate type stokers are disclosed in U.S. Pat. Nos. 697,620 to Green et al; 3,152,562 to Cohan et al; 4,510,873 to Shigaki; and 4,876,972 to Mrklas.

In view of the depletion of natural energy sources, the increased interest in combusting alternative waste materials and the increased concerns regarding air pollution, stoker type furnaces need to be more efficient and produce less pollutants. Accordingly, it is apparent that there exists a need for improving the efficiency of stoker type furnaces as well as a need to decrease the amount of pollutants produced by stoker type furnaces. This invention addresses these needs in the art, along with other needs which will become apparent to those skilled in the art once given this disclosure.

SUMMARY OF THE INVENTION

One object of the present invention is to provide at least one foil for injecting a non-aqueous, combustion enhancing fluid, such as air, oxygen or a pollutant reducing gas into the fuel bed of a furnace at a predetermined location or locations to enhance combustion.

Another object of the present invention is to provide at least one foil in the fuel bed to create turbulence in the fuel to enhance combustion.

Yet another object of the present invention is to provide at least one foil which can be selectively positioned within the combustion zone for optimizing combustion of the fuel.

Still another object of the present invention is to provide at least one foil which can be retrofitted to an existing furnace to enhance its combustion.

A further object of the present invention is to provide at least one foil which can be installed in a wide variety of stoker type furnaces.

Another object of the present invention is to provide a foil for in-bed combustion enhancement which is relatively easy to manufacture and install.

The foregoing objects can basically be attained by providing a stoker combustion system for a furnace, comprising: a traveling grate for supporting a bed of fuel, the grate having an upper movable grate surface extending between a first end of the grate for receiving fuel to be burned and a second end of the grate for discharging spent fuel; a piping system for supplying combustion air beneath the upper grate surface of the grate; a combustion enhancing member with a fluid receiving cavity positioned above the upper grate surface, the combustion enhancing member having a fuel engaging exterior surface with at least one passageway in fluid communication with the cavity for ejecting the fluid from the cavity into the fuel moving along the grate; and a source of pressurized fluid in a fluid communication within the cavity of the combustion enhancing member for injecting a non-aqueous combustion enhancing agent into an area of the bed of fuel, the combustion enhancing member being located in at least one oxygen deficient zone or maximum reactivity zone of ignited fuel on the bed of fuel.

The foregoing objects are also attained by the method of enhancing combustion of a burning fuel within a combustion zone of a furnace, comprising the steps of supplying fuel to the combustion zone by a traveling grate having an upper movable grate surface extending between a first end of the grate which receives the fuel to be burned and a second end of the grate which discharges spent fuel therefrom; supplying combustion air beneath the upper grate surface of the traveling grate; providing a combustion foil with a fluid receiving cavity above the upper grate surface of the traveling grate for enhancing combustion of the fuel, the combustion enhancing member having a fuel engaging exterior surface with at least one passageway therein; and injecting a pressurized fluid into the fuel moving along the traveling grate via the at least one passageway formed in the combustion enhancing member, the fluid containing a non-aqueous combustion enhancing agent.

Other objects, advantages and salient features of the present invention will become apparent from the following detailed description, which, taken in conjunction wit the annexed drawings, disclosed a preferred embodiment of the present invention.

BRIEF DESCRIPTION OF THE DRAWINGS

Referring to the drawings which form part of this original disclosure.

DESCRIPTION OF THE PREFERRED EMBODIMENT

Figure 1:
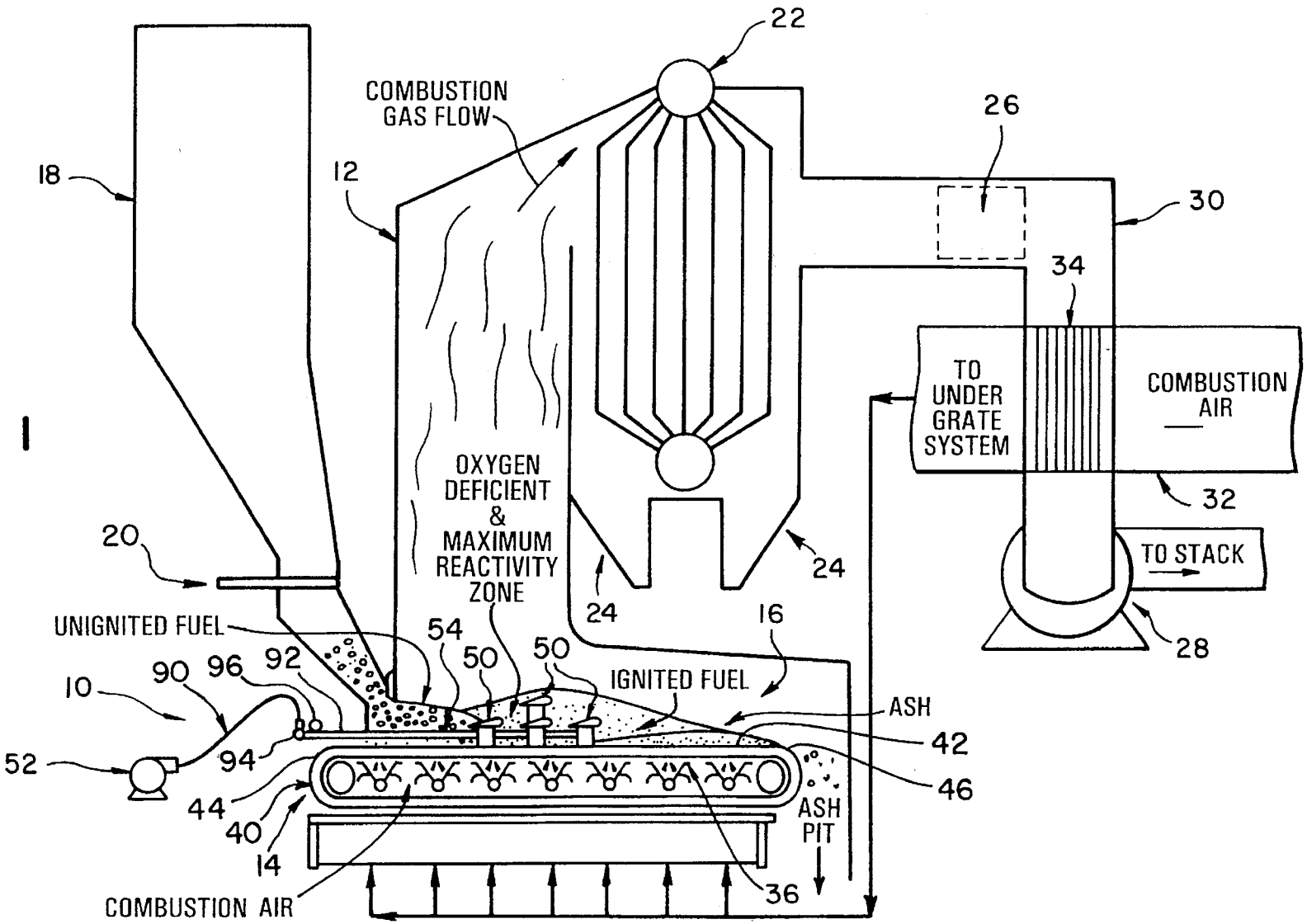
FIG. 1 is a schematic representation in cross-section of a furnace with a traveling grate type stoker utilizing a plurality of foils in accordance with the present invention.

Referring initially to FIG. 1, a combustion enhancement system 10 in accordance with the present invention is illustrated in conjunction with a furnace 12 and a stoker 14. Basically, combustion enhancement system 10 is designed to enhance the combustion of the fuel being burned in furnace 12 on stoker 14. This enhancement of combustion includes increasing the efficiency of the fuel being burned on the stoker as well as modifying the exhaust gas or emissions of the fuel being burned to reduce pollutants given off to the atmosphere. The enhancement of combustion is accomplished by injecting a non-aqueous combustion enhancing fluid into the fuel bed on stoker 14 and by creating turbulence of the fuel in the fuel bed.

The term "non-aqueous combustion enhancing fluid" as used herein refers to any gas or gases which contain a material or agent that increases the efficiently of combustion or that modifies the emissions produced by the burning fuel. Accordingly, the non-aqueous, combustion enhancing fluid can contain several different gases as well as solid and/or liquids (other than merely water) or any combination thereof. The non-aqueous, combustion enhancing fluid can include any known emission controlling agent to modify the emissions produced by the burning fuel.

It will be apparent to those skilled in the art from this disclosure that the specific design of combustion enhancement system 10 will depend on a number of factors including the particular process, the particular type of furnace and the particular attributes of the fuel being burned. In other words, it will be apparent to those skilled in the art from this disclosure that combustion enhancement system 10 can be used in other types of furnaces other than the one shown and illustrated herein, and that combustion enhancement system 10 can be modified to suit the particular requirements of the particular furnace in which it is to be installed.

In order to facilitate the understanding of the subject invention, furnace 12 and stoker 14 will be briefly discussed herein. Of course, furnace 12 and stoker 14 are conventional equipment, which are well known in the prior art. Therefore, this disclosure will not discuss the details of furnace 12 and stoker 14. Moreover, combustion enhancement system 10 is not limited to the furnace 12 and stoker 14 discussed and illustrated herein.

Stoker 14 is positioned in combustion zone 16 of furnace 12 and receives fuel from fuel bunker 18. Bunker 18 has a gate 20 for stopping the flow of fuel being fed to stoker 14. Accordingly, the fuel is gravity fed from fuel bunker 18 to stoker 14. The fuel being fed to stoker 14 from bunker 18 is regulated by the speed of the stoker 14. By way of example, furnace 12 illustrated in FIG. 1 includes a boiler drum 22, a pair of ash hoppers 24, an economizer 26, an induced draft fan 28, an exhaust duct system 30 and an inlet duct system 32. The duct system 32 can include an air preheater 34 for preheating the main air supply being supplied to combustion zone 16. The inlet duct system 32 is connected to air registers 36 positioned in stoker 14 for supplying the main combustion air to combustion zone 16.

Stoker 14 is preferably a conventional traveling grate-type stoker having a continuous grate 40 which moves the fuel along combustion zone 16. Grate 40 is preferably a continuous belt or chain with perforations for allowing combustion air from air registers 36 to pass therethrough. Grate 40 has an upper surface 42 for supporting and moving fuel through combustion zone 16. More specifically, stoker 14 has a leading end 44 for receiving fuel from fuel bunker 18 and a trailing end 46 for discharging the burnt fuel or ash to an ash pit. As the fuel is carried along the top surface 42 of grate 40 from leading end 44 to trailing end 46, the bed of fuel on grate 40 begins to burn from the top of the fuel bed downwardly towards top surface 42 of grate 40. The main combustion air for the burning of the fuel is supplied via air registers 36 beneath top surface 42 of grate 40.

Figure 2:
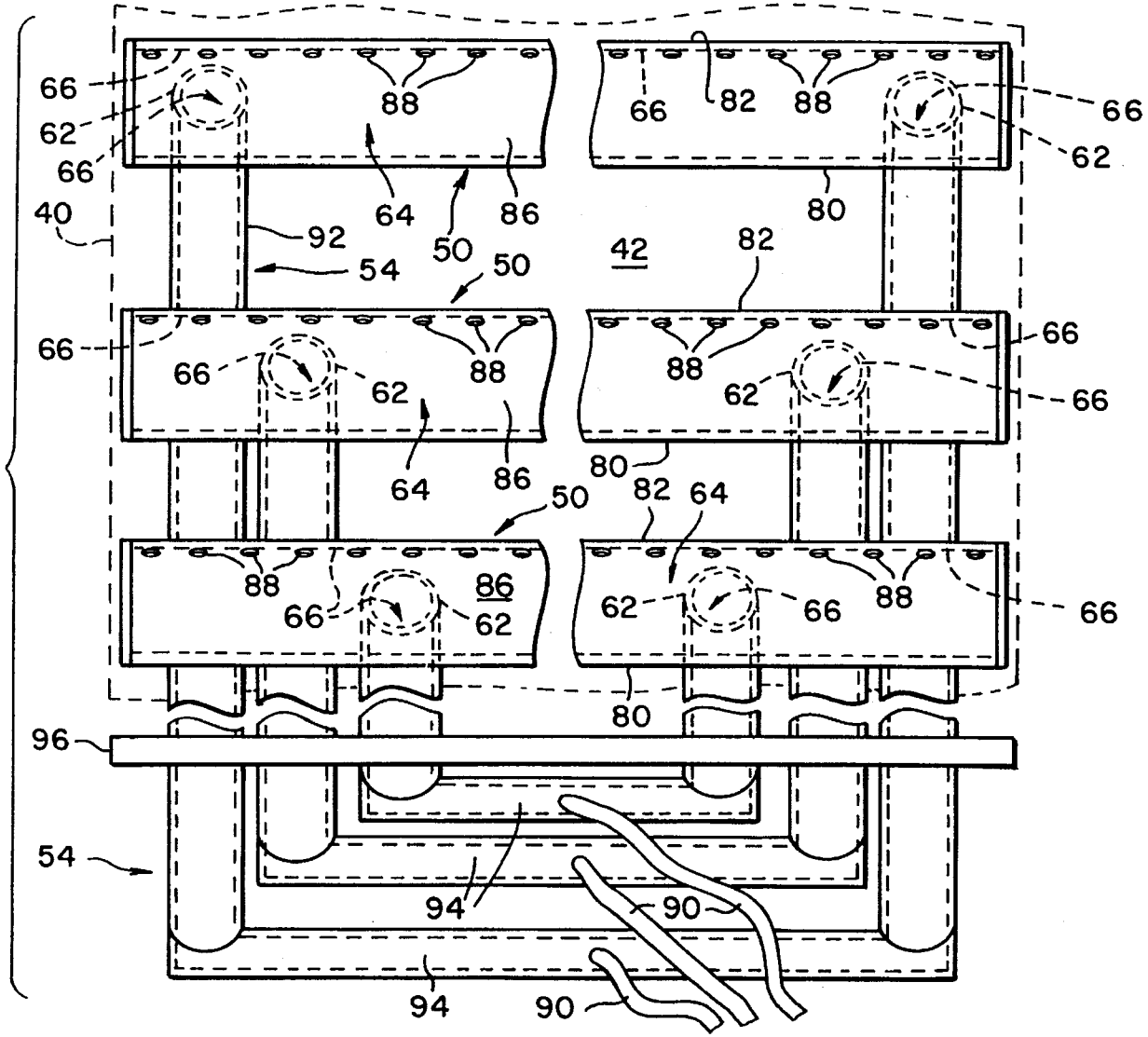
FIG. 2 is a partial top plan view of the foils illustrated in FIG. 1 with the traveling grate being illustrated in broken lines.

Referring now particularly to combustion enhancement system 10 as illustrated in FIGS. 1 and 2, system 10 includes a plurality of combustion enhancing members 50 slidably supported on upper surface 42 of grate 40. A source of high pressure fluid 52 is connected to combustion enhancing members 50 via piping system 54 for supplying a pressurized fluid such as compressed air or oxygen enriched air thereto. While three combustion enhancing members 50 are illustrated in combustion enhancement system 10, it will be apparent to those skilled in the art from this disclosure that the number of combustion enhancing members as well as their positioning and/or their arrangement within the combustion zone will depend upon a number of factors, including the type of fuel being burned as well as the type of stoker and furnace being used.

In order to optimize combustion enhancement system 10 for use with any particular furnace, a series of tests or simulations can be conducted to determine the optimal design for the particular furnace. Preferably, the tests are conducted on the proposed furnace being retrofitted or installed with combustion enhancement system 10. Alternatively, a combustion test bed or mathematical routines and computer coding can be used to verify the design and calculate the impact that changes in the combustion process will have on the installation.

For example, Pennsylvania State University has a combustion test bed which can be used to verify various designs for a stoker combustion enhancement system in accordance with the present invention. The testing determines oxygen deficient areas as well as maximum reactivity zones within the fuel bed. Thus, after determining areas of oxygen deficiency and/or areas of maximum reactivity zones, combustion enhancing members 50 are placed in those areas for receiving a non-aqueous, combustion enhancing fluid such as air or oxygen to increase combustion efficiency and/or to change and chemically react with the gases produced by burning the fuel to control emissions.

In addition to using a combustion test bed, there are numerous mathematical routines and computer coding available to verify designs for placing the combustion enhancing members within the stoker. These mathematical routines and computer coding calculates the impact that various changes in the combustion process have on the system. These codes include PCGC-3 which has been developed at the Advanced Combustion Engineering Research Center, which is a program funded by the National Science Foundation with industry support. Moreover, there are commercially available codes for conducting mathematical routines and computer codings which are available through Reaction Engineering International, Fluent, Stone & Webster. These various commercial codes can be used to verify, design and determine the impact of the design on the combustion process.

Figure 4:
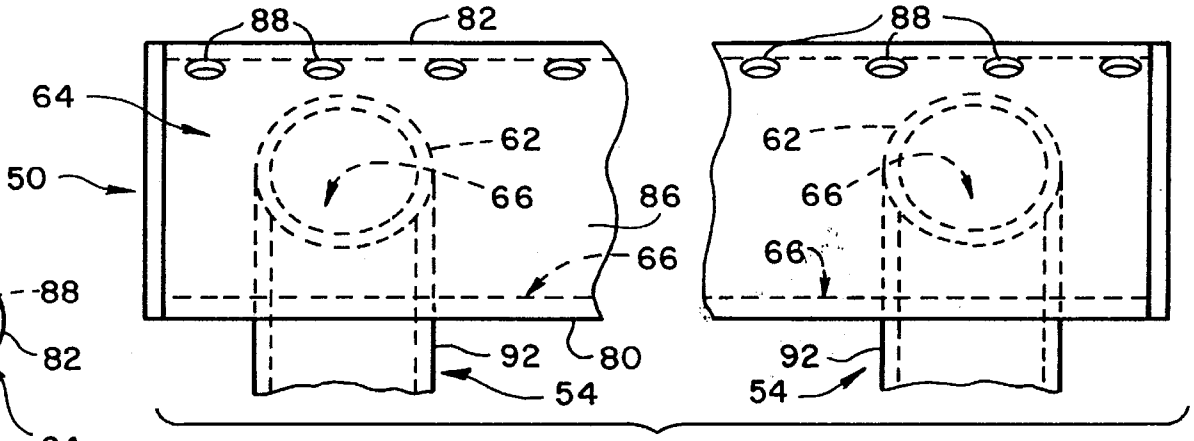
FIG. 4 is an enlarged partial top plan view of one of the combustion foils illustrated in FIGS. 1 and 2.
Figure 5:
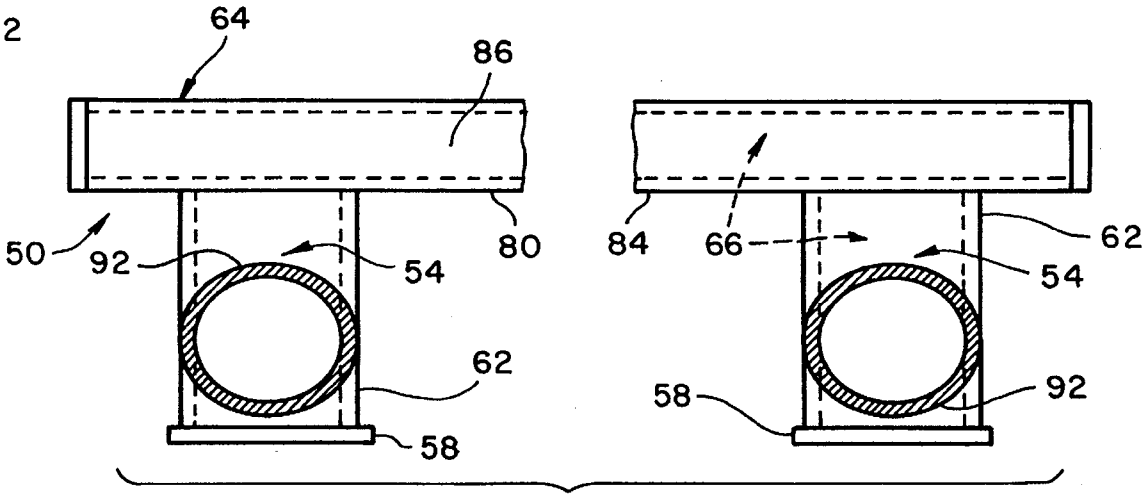
FIG. 5 is an enlarged, partial left end elevational view of one of the foils illustrated in FIGS. 1 and 2.
Figure 3:
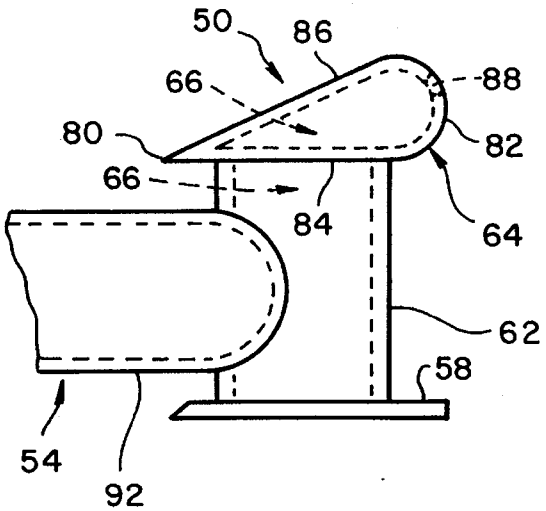
FIG. 3 is an enlarged partial side elevational view of one of the foils illustrated in FIGS. 1 and 2.

As best seen in FIGS. 3–5, each combustion enhancing member 50 preferably includes a pair of skid plates 58 for riding on the top surface 42 of grate 40, a pair of pedestals 62 extending upwardly from skid plates 58, and at least one foil or wing-shaped member 64 attached to the upper ends of pedestals 62. Pedestals 62 and foils or wing-shaped members 64 are hollow and form a fluid receiving cavity 66, which is fluidly connected to high pressure fluid source 52 via piping system 54.

Combustion enhancing members 50 as well as piping system 54 are both constructed of a high temperature resistant material since the temperature in combustion zone 16 can reach temperatures of up to 3200° Fahrenheit. Of course, the gas or fluid flowing through the system will provide some cooling to the system. Thus, the amount of gas and the position of the combustion foil in the stoker fuel bed will affect the type of material to be used. Examples of some suitable materials for combustion enhancing members 50 and piping system 54 include fused silica or Vycor if the design and temperature warrant the use of ceramics, and nichrome, Group "H" steels or Group "T" steels if the design and temperature warrant the use of a metal.

Pedestals 62 are preferably cylindrical hollow members which are in fluid communication with piping system 54 and foil 64. Of course, pedestals 62 could have different shapes depending upon the particular type of fuel being burned. While only two pedestals 62 per combustion foil 50 are illustrated, it will be apparent to those skilled in the art that more pedestals could be used to support each foil 64 as needed and/or desired.

Pedestals 62 determine the height of foils 64 above grate 40. Preferably, pedestals 62 support foils 64 in the upper half of the fuel bed. Of course, the height of each set of pedestals 62 will depend upon the location of the oxygen deficient and maximum reactivity areas in which the fluid from foil 64 is to be injected, and the desired turbulence to be created within the fuel bed. Typically, the height of each set of pedestals is designed to place its respective foil or foils 64 in oxygen deficient areas or maximum reactivity areas to enhance combustion and to control emissions. Accordingly, a wide range of combustion enhancing systems can be formed in accordance with the present invention to accommodate the particular requirements of various furnaces and/or fuels.

Piping system 54 is rigidly coupled connected to pedestals 62 so that longitudinal movement of piping system 54 also moves foils 50 longitudinally along top surface 42 of grate 40. This permits combustion enhancing members 50 to be selectively positioned within the combustion zone 16. In other words, the position of combustion enhancing members 50 can be adjusted by longitudinal movement of piping system 54. This is important since the optimal position of combustion enhancing members 50 can change depending on the type of fuel being burned in the furnace.

As best seen in FIG. 3, each of the foils 64 preferably has a tear-shaped cross-section with a hollow interior in fluid communication with pedestals 62 for receiving the high pressured fluid from source 52 via piping system 54. Foils 64, preferably, extend substantially the entire width of grate 40, and have a pointed leading edge 80 and a curved trailing edge 82 with bottom and top surfaces 84 and 86, respectively, extending therebetween. The shape of each foil 64 is designed to create turbulence within the fuel bed to increase combustion efficiency of the fuel and/or maximize the chemical reaction between the non-aqueous, combustion enhancing fluid being injected into the fuel bed to control the emissions given off by the burning fuel. While foils 64 are all illustrated as identical members, it will be apparent to those skilled in the art that each of the foils 64 can have a different shape from the other foils to suit the requirements of the particular furnace and/or fuel being burned therein.

Preferably, bottom surface 84 of each foil 64 extends substantially parallel to top surface 42 of grate 40, or is slightly angled upwardly from its leading edge 80 to trailing edge 82. Top surface 86 of each foil 64 has preferably a steeper angle which allows the fuel in the bed to be separated. In other words, the top surface 86 is inclined upwardly from its leading edge 80 to its trailing edge 82. This shape of foil 64 allows the fuel moving along the bed to be separated by foil 64 such that a portion of the fuel is lifted and tumbled over top surface 86 of foil 64 to create turbulence within the fuel bed.

A plurality of perforations or nozzles 88 are provided at trailing edge 82 of each foil 64 for injecting a fluid under pressure into the tumbling fuel. Alternatively, the entire foil 64 can be constructed out of a porous, high temperature resistant ceramic such that the high pressured gas is injected into the fuel from all directions. Likewise, the positioning of perforations or nozzles 88 can be located at various positions on foil 64 to maximize and/or optimize combustion of the fuel, or to maximize and/or optimize the desired reaction of the gases within the fuel bed. Preferably, nozzles 88 are positioned at the upper end of trailing edges 82 of foils 64 such that the non-aqueous, combustion enhancing fluid is injected into the fuel falling from top surfaces 86 of foils 64.

Combustion enhancing members 50 can be either single tiered foils, i.e., a single wing-shaped member or, or a multiple tiered foil with a plurality of wing-shaped members or foils 64 vertically arranged or stacked. In the case of a multiple tiered foil, additional pedestals 62 would fluidly interconnect the lower foil up to the top or uppermost foil. It will be apparent from this disclosure that combustion enhancing system 10 can have any combination of single tiered foils and/or multiple tiered foils with each of the foils having various heights and shapes to accommodate the requirements of the furnace or fuel being burned therein.

In order to assist in the even distribution of the pressurized fluid extending therethrough, various damper systems may be used in combustion enhancing members 50 and in piping system 54, to regulate the flow of fluid therethrough. Accordingly, by using a damper system, more air can be directed to certain parts of the foil as opposed to other parts or there can be a uniform flow throughout. For example, finer fuel in a traveling grate-type stoker typically tends to flow towards the center of the fuel bed, while larger size fuel tends to flow towards the end of the grate. Thus, by zoning the foils, these differences in the composition of the fuel bed can be accommodated.

High pressure fluid source 52 can be any conventional equipment known for supplying a non-aqueous, combustion enhancing fluid under pressure into the ignited fuel on grate 40. In fact, source 52 can be constructed of conventional equipment which can supply different types of non-aqueous, combustion enhancing fluids to the foils 50. For example, some of the foils 64 can receive a first type of fluid, while other foils 64 receive a second type of fluid. In other words, high pressure fluid source 52 can be used to inject a variety of fluids into the fuel bed by foils 64 to selectively control the combustion of the fuel. Some examples of non-aqueous, combustion enhancing fluids which can be injected into the fuel bed includes oxygen, air, oxygen enriched air or any other type of suitable non-aqueous, combustion enhancing agent or gas.

Moreover, a variety of materials or agents can be injected into the fluid bed by being entrained within the gas. For example, powdered limestone, magnesium oxide, calcium carbonate or any other suitable emission controlling agent could be entrained within a gas for controlling and improving the emissions produced by the burning fuel. If telephone poles are burned in the furnace, the telephone pole typically gives off emissions containing various undesirable by-products. To neutralize these undesirable by-products produced by the burning telephone poles, a reactant or agent can be introduced into the fuel bed at the area of maximum reactivity to react with these undesirable by-products in the emissions. Thus, the type of agent, gas or effluent being injected into the fuel bed will depend upon the type of fuel being burned.

As seen in FIGS. 1 and 2, piping system 54 includes, for example, a plurality of flexible conduits 90, a plurality of rigid conduits 92, a plurality of manifold conduits 94, and a supporting and positioning member 96. Flexible conduits 90 are fixedly connected at one of their ends to high pressure fluid source 52 and fixedly coupled at their other ends to foils 50 via conduits 92 and 94. The precise construction of piping system 54, i.e., number of flexible conduits 90, the number of rigid conduits 92, and the number of manifold conduits 94, depends on a number of factors such as whether the combustion enhancing members are independently adjustable and/or whether more than one type of non-aqueous, combustion enhancing fluid is being supplied to combustion foils 64. The piping system 54 shown in FIG. 2 allows for individual adjustment of the foils 64 within the ignited fuel bed. Alternatively, foils 64 can all be interconnected as a single unit, which would move together when adjusted.

If a single type of non-aqueous combustion enhancing fluid is being supplied to combustion foils 64, then a single flexible conduit 90 and a single manifold conduit 94 can be utilized for supplying the combustion enhancing fluid to foil 64. Of course, if different types of non-aqueous, combustion enhancing fluids are to be delivered to the combustion foils 64, then a plurality of flexible conduits 90 would be utilized together with a plurality of manifold conduits 94.

Rigid conduits 92 are rigidly connected at one of their ends to the outlets of manifold conduits 94 and rigidly connected at their other ends to pedestals 62 of combustion enhancing members 50. Accordingly, longitudinal movement of rigid conduits 92 will in turn cause longitudinal movement of the combustion enhancing members 50 connected thereto. This longitudinal movement of rigid conduits 92 is controlled by supporting and positioning member 96.

Supporting and positioning member 96 can be basically a transverse bar or rod with individual supports or brackets slidably maintaining each of the rigid conduits 92 in their proper position for longitudinal movement relative combustion zone 16. The precise construction of supporting and positioning member 96 is not pertinent to the subject invention. Rather, any supporting and positioning member can be utilized which allows the foils 64 to be individually moved along the top surface 42 of grate 40.

Manifold conduits 94 are conventional rigid manifold conduits with inlets corresponding to the number of flexible conduits 90 coupled thereto and outlets corresponding to the number of rigid conduits 92 coupled thereto. In other words, manifold conduits 94 can be sectioned for accommodating several types of non-aqueous, combustion enhancing fluids. The precise construction of manifold conduits 94 are not pertinent to the subject invention. Accordingly, manifold conduits 94 will not be discussed or illustrated in detail herein.

In use, the combustion enhancement system 10 is either retrofitted to an existing furnace or installed with a new furnace by first determining areas of oxygen deficiency as well as the areas of maximum reactivity. This can be done as mentioned above by performing actual tests on the actual furnace to determine the areas or zones of oxygen deficiency and the areas or zones of maximum reactivity for that particular furnace and the particular fuel being burned therein. Alternatively, the areas of oxygen deficiency and the areas of maximum reactivity could be determined on a combustion test bed such as the one at Pennsylvania State University, or by using mathematical routines and computer codings to calculate these areas of oxygen deficiency or maximum reactivity.

Once these areas are determined for the particular furnace and the particular fuel to be burned, a particular combustion enhancement system 10 can be developed to position combustion foils 64 at their optimum points within the combustion zone 16 to optimize combustion and emissions. In other words, by using the combustion test bed at Pennsylvania State University or the various mathematical routines and computer codes, a particular design and its impact on the combustion process can be determined and optimized. Therefore, depending upon the system, one or more foils 64 may be needed to enhance combustion. Likewise, the foil or foils 64 may be either single tiered or multiple tiers and/or any combination thereof to obtain the desired result.

While only one embodiment has been chosen to illustrate the invention, it will be understood by those skilled in the art that various changes and modifications can be made herein without departing from the scope of the invention as defined in the appended claims.

What is claimed is:

1. A stoker combustion enhancing system for a furnace, comprising:

a traveling grate for supporting a bed of fuel, said grate having an upper movable grate surface extending between a first end of said grate for receiving fuel to be burned and a second end of said grate for discharging spent fuel;

a first piping system for supplying combustion air beneath said upper grate surface of said grate;

a combustion enhancing member with a fluid receiving cavity positioned above said upper grate surface, said combustion enhancing member having a fuel engaging exterior surface with at least one passageway in fluid communication with said cavity for ejecting the fluid from said cavity into the fuel moving along said grate; and a second piping system, independent from said first piping system, providing a source of pressurized fluid in fluid communication with said cavity of said combustion enhancing member for injecting a non-aqueous combustion enhancing agent into an area of the bed of fuel, said combustion enhancing member being located in at least one oxygen deficient zone or maximum reactivity zone of ignited fuel on the bed of fuel.

2. A stoker combustion system according to claim 1, wherein said combustion enhancing member includes a first foil.

3. A stoker combustion system according to claim 1, wherein said source of pressurized fluid contains an emission controlling agent.

4. A stoker combustion system according to claim 3, wherein said emission controlling agent is a solid material entrained in a gas.

5. A stoker combustion system according to claim 4, wherein said gas is oxygen enriched air.

6. A stoker combustion system according to claim 1, wherein said source of pressurized fluid is an oxygen enriched gas.

7. A stoker combustion system according to claim 1, wherein said source of pressurized fluid is compressed air.

8. A stoker combustion system according to claim 1, further comprising a plurality of said combustion enhancing members positioned in series above said grate within the ignited fuel.

9. A stoker combustion enhancing system for a furnace, comprising:

a traveling grate for supporting a bed of fuel, said grate having an upper movable grate surface extending between a first end of said grate for receiving fuel to be burned and a second end of said grate for discharging spent fuel:

a piping system for supplying combustion air beneath said upper grate surface of said grate;

a combustion enhancing member with a fluid receiving cavity positioned above said upper grate surface, said combustion enhancing member having a fuel engaging exterior surface with at least one passageway in fluid communication with said cavity for ejecting the fluid from said cavity into the fuel moving along said grate; and a source of pressurized fluid in fluid communication with said cavity of said combustion enhancing member for injecting a non-aqueous combustion enhancing agent into an area of the bed of fuel, said combustion enhancing member being located in at least one oxygen deficient zone or maximum reactivity zone of ignited fuel on the bed of fuel, said combustion enhancing member including a first foil, and a pedestal connected to said foil.

10. A stoker combustion system according to claim 9, wherein said combustion enhancing member further includes a second foil coupled to said first foil.

11. A stoker combustion system according to claim 10, wherein each of said first and second foils has a wedge-shaped leading edge and a trailing edge spaced from said leading edge.

12. A stoker combustion system according to claim 11, wherein each of said first and second foils has a top surface inclined upwardly from its respective said leading edge to its respective said trailing edge.

13. A stoker combustion system according to claim 12, wherein said at least one passageway is formed in one of said first and second foils at its said respective trailing edge.

14. A stoker combustion system according to claim 12, wherein each of said foils has said passageway formed therein at their said trailing edge.

15. A stoker combustion enhancing system for a furnace, comprising:

a traveling grate for supporting a bed of fuel, said grate having an upper movable grate surface extending between a first end of said grate for receiving fuel to be burned and a second end of said grate for discharging spent fuel;

a piping system for supplying combustion air beneath said upper grate surface of said grate;

a combustion enhancing member with a fluid receiving cavity positioned above said upper grate surface, said combustion enhancing member having a fuel engaging exterior surface with at least one passageway in fluid communication with said cavity for ejecting the fluid from said cavity into the fuel moving along said grate; and a source of pressurized fluid in fluid communication with said cavity of said combustion enhancing member for injecting a non-aqueous combustion enhancing agent into an area of the bed of fuel, said combustion enhancing member being located in at least one oxygen deficient zone or maximum reactivity zone of ignited fuel on the bed of fuel, a plurality of said combustion enhancing members positioned in series above said grate within the ignited fuel, each of said combustion enhancing members includes a pedestal supported on said upper grate surface, and at least one first foil spaced above said grate surface with said at least one passageway being formed therein.

16. A stoker combustion system according to claim 15, wherein each of said combustion enhancing members includes a leading edge, a trailing edge, a bottom surface extending between said leading edge and said trailing edge, and a top surface extending between said leading edge and said trailing edge, said bottom surface being substantially parallel to said upper grate surface and said top surface being angled upwardly from said leading edge to said trailing edge such that said leading edge forms a wedge.

17. A stoker combustion system according to claim 16, wherein at least one of said combustion enhancing members includes a second foil coupled above its respective said first foil.

18. A stoker combustion system according to claim 17, wherein said second foil is in fluid communication with said source of pressurized fluid.

19. A method of enhancing combustion of a burning fuel within a combustion zone of a furnace, comprising the steps of supplying fuel to said combustion zone by a traveling grate having an upper movable grate surface extending between a first end of said grate which receives the fuel to be burned and a second end of said grate which discharges spent fuel therefrom;

supplying combustion air, through a first piping system, beneath said upper grate surface of said traveling grate;

providing a combustion enhancing member with a fluid receiving cavity above said upper grate surface of said traveling grate for enhancing combustion of the fuel, said combustion enhancing member having a fuel engaging exterior surface with at least one passageway therein; and injecting a pressurized fluid, through a second piping system independent from said first piping system, into the fuel moving along said traveling grate via said at least one passageway formed in said combustion enhancing member, said fluid containing a non-aqueous combustion enhancing agent.

20. The method of enhancing combustion according to claim 19, wherein said pressurized fluid contains compressed air which is injected into an oxygen deficient zone of the burning fuel.

21. The method of enhancing combustion according to claim 19, wherein said pressurized fluid contains an emission controlling agent which is injected into a maximum reactivity zone of the burning fuel to react with emissions from the burning fuel.

22. The method of enhancing combustion according to claim 19, further comprising the step of providing a plurality of said combustion enhancing members in said burning fuel.

23. The method of enhancing combustion according to claim 19, wherein said combustion enhancing member includes a first foil.

24. The method of enhancing combustion according to claim 23, wherein said at least one passageway is formed in said first foil.

25. The method of enhancing combustion of a burning fuel within a combustion zone of a furnace comprising the steps of supplying fuel to said combustion zone by a traveling grate having an upper movable grate surface extending between a first end of said grate which receives the fuel to be burned and a second end of said grate which discharges spent fuel therefrom;

supplying combustion air beneath said upper grate surface of said traveling grate:

providing a combustion enhancing member with a fluid receiving cavity above said upper grate surface of said traveling grate for enhancing combustion of the fuel, said combustion enhancing member having a fuel engaging exterior surface with at least one passageway therein and said combustion enhancing member including a first foil and a pedestal connected to said foil; and injecting a pressurized fluid into the fuel moving along said traveling grate via said at least one passageway formed in said combustion enhancing member, said fluid containing a non-aqueous combustion enhancing agent.

26. The method of enhancing combustion according to claim 25, wherein said combustion enhancing member further includes a second foil coupled to said first foil.

27. The method of enhancing combustion according to claim 26, wherein each of said first and second foils has a wedge-shaped leading edge and a trailing edge spaced from said leading edge.

28. The method of enhancing combustion according to claim 27, wherein each of said first and second foils has a top surface inclined upwardly from its respective said leading edge to its said trailing edge.

29. A stoker combustion enhancing system for a furnace, comprising:

a traveling grate for supporting a bed of fuel, said grate having an upper movable grate surface extending between a first end of said grate for receiving fuel to be burned and a second end of said grate for discharging spent fuel;

a first piping system for supplying combustion air beneath said upper grate surface of said grate;

a combustion enhancing member with a fluid receiving cavity positioned above said upper grate surface, said combustion enhancing member having a fuel engaging exterior surface with at least one passageway in fluid communication with said cavity for ejecting the fluid from said cavity into the fuel moving along said grate; and a source of pressurized fluid in fluid communication with said cavity of said combustion enhancing member for injecting a non-aqueous combustion enhancing agent into an area of the bed of fuel, said combustion enhancing member being located in at least one oxygen deficient zone or maximum reactivity zone of ignited fuel on the bed of fuel and movably mounted within the bed of fuel for longitudinal movement along said upper movable grate surface.

30. A stoker combustion system according to claim 29, wherein said combustion enhancing member has at least one skid plate located on said upper movable grate surface.

31. A stoker combustion system according to claim 29, further comprising a second, longitudinally movable piping system connects said source of pressurized fluid to said cavity.

32. A stoker combustion enhancing system for a furnace, comprising:

a traveling grate for supporting a bed of fuel, said grate having an upper movable grate surface extending between a first end of said grate for receiving fuel to be burned and a second end of said grate for discharging spent fuel;

a piping system for supplying combustion air beneath said upper grate surface of said grate;

a combustion enhancing member with a fluid receiving cavity positioned above said upper grate surface, said combustion enhancing member having a fuel engaging exterior surface with a wedge-shaped leading edge, a trailing edge spaced from said leading edge, and at least one passageway in fluid communication with said cavity for ejecting the fluid from said cavity into the fuel moving along said grate; and a source of pressurized fluid in fluid communication with said cavity of said combustion enhancing member for injecting a non-aqueous combustion enhancing agent into an area of the bed of fuel, said combustion enhancing member being located in at least one oxygen deficient zone or maximum reactivity zone of ignited fuel on the bed of fuel.

33. A stoker combustion system according to claim 32, wherein said at least one passageway is formed at said trailing edge.

34. A method of enhancing combustion of a burning fuel within a combustion zone of a furnace, comprising the steps of supplying fuel to said combustion zone by a traveling grate having an upper movable grate surface extending between a first end of said grate which receives the fuel to be burned and a second end of said grate which discharges spent fuel therefrom;

supplying combustion air beneath said upper grate surface of said traveling grate by a first piping system;

providing a combustion enhancing member with a fluid receiving cavity above said upper grate surface of said traveling grate for enhancing combustion of the fuel, said combustion enhancing member having a fuel engaging exterior surface with at least one passageway therein, selectively moving said combustion enhancing member longitudinally along said upper movable grate to position said combustion enhancing member at a particular location within the fuel bed; and injecting a pressurized fluid into the fuel moving along said traveling grate via said at least one passageway formed in said combustion enhancing member, said fluid containing a non-aqueous combustion enhancing agent.

35. A method of enhancing combustion according to claim 34, wherein said combustion enhancing member has at least one skid plate located on said upper movable grate.

36. A method of enhancing combustion according to claim 34, further comprising a second, longitudinally movable piping system connects said pressurized fluid to said passageway.

37. A method of enhancing combustion of a burning fuel within a combustion zone of a furnace, comprising the steps of supplying fuel to said combustion zone by a traveling grate having an upper movable grate surface extending between a first end of said grate which receives the fuel to be burned and a second end of said grate which discharges spent fuel therefrom;

supplying combustion air beneath said upper grate surface of said traveling grate;

providing a combustion enhancing member with a fluid receiving cavity above said upper grate surface of said traveling grate for enhancing combustion of the fuel, said combustion enhancing member having a fuel engaging exterior surface with a wedge-shaped leading edge, a trailing edge spaced from said leading edge, and at least one passageway therein, said fuel engaging exterior surface creating turbulence within the fuel; and injecting a pressurized fluid into the fuel moving along said traveling grate via said at least one passageway formed in said combustion enhancing member, said fluid containing a non-aqueous combustion enhancing agent.

38. A method of enhancing combustion according to claim 37, wherein said at least one passageway is formed at said trailing edge.

* * * * *